US011504868B2

(12) United States Patent
Yasui

(10) Patent No.: US 11,504,868 B2
(45) Date of Patent: Nov. 22, 2022

(54) PRINTER AND METHOD FOR CUTTING CONTINUOUS PAPER BY THE SAME

(71) Applicant: TOSHIBA TEC KABUSHIKI KAISHA, Tokyo (JP)

(72) Inventor: Yuji Yasui, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 614 days.

(21) Appl. No.: 16/522,694

(22) Filed: Jul. 26, 2019

(65) Prior Publication Data

US 2020/0094429 A1 Mar. 26, 2020

(30) Foreign Application Priority Data

Sep. 25, 2018 (JP) ..... JP2018-179343

(51) Int. Cl.

| | |
|---|---|
| ***B26D 5/08*** | (2006.01) |
| ***B26D 1/08*** | (2006.01) |
| ***B41J 11/70*** | (2006.01) |
| ***B41J 11/66*** | (2006.01) |
| *B41J 15/04* | (2006.01) |

(52) U.S. Cl.

CPC ..... *B26D 1/085* (2013.01); *B26D 5/08* (2013.01); *B41J 11/663* (2013.01); *B41J 11/706* (2013.01); *B41J 15/042* (2013.01)

(58) Field of Classification Search

CPC ..... B26D 1/085; B26D 5/08; B41J 11/663; B41J 11/706; B41J 15/042

See application file for complete search history.

(56) References Cited

U.S. PATENT DOCUMENTS

| | | | | |
|---|---|---|---|---|
| 5,823,692 | A * | 10/1998 | Tolrud | B65H 29/246 400/582 |
| 7,967,517 | B2 * | 6/2011 | Wada | B26D 5/34 400/621 |
| 9,033,601 | B2 * | 5/2015 | Koike | B41J 11/663 400/621 |

(Continued)

FOREIGN PATENT DOCUMENTS

| | | |
|---|---|---|
| JP | 2010-042582 | 2/2010 |
| JP | 2010-069722 | 4/2010 |

OTHER PUBLICATIONS

Extended European Search Report for European Patent Application No. 19193331.6 dated Feb. 5, 2020.

*Primary Examiner* — Jill E Culler

(74) *Attorney, Agent, or Firm* — Amin, Turocy & Watson, LLP

(57) ABSTRACT

A printer comprises a cutter; a non-volatile storage module; a command receiving module configured to receive a command for instructing a cutting method of a continuous paper from an information processing apparatus connected to the printer; a first cutting control module configured to control an operation of the cutter to cut the continuous paper in the cutting method instructed by the command; a recording module configured to record information indicating the cutting method in the storage module at the time of paper cutting based on the command; and a second cutting control module configured to cut the continuous paper in a cutting method indicated by the information stored in the storage module at the time of paper cutting without the command.

20 Claims, 4 Drawing Sheets

(56) References Cited

U.S. PATENT DOCUMENTS

| | | | | |
|---|---|---|---|---|
| 9,844,958 | B2 * | 12/2017 | Kako | B41J 11/663 |
| 2005/0271446 | A1 | 12/2005 | Minowa | |
| 2008/0290578 | A1 * | 11/2008 | Ebihara | B41J 11/70<br>270/5.02 |
| 2014/0182463 | A1 * | 7/2014 | Muto | B26D 7/27<br>101/3.1 |
| 2017/0182803 | A1 | 6/2017 | Kataoka et al. | |

* cited by examiner

PRINTER AND METHOD FOR CUTTING CONTINUOUS PAPER BY THE SAME

CROSS-REFERENCE TO RELATED APPLICATION

This application is based upon and claims the benefit of priority from Japanese Patent Application No. 2018-179343, filed on Sep. 25, 2018, the entire contents of which are incorporated herein by reference.

FIELD

Embodiments described herein relate generally to a printer.

BACKGROUND

A printer for printing a receipt or a coupon is connected to or mounted on a POS (Point Of Sales) terminal, a self-service checkout apparatus or a checkout apparatus of a semi-self-service checkout system. A cutting method of a continuous paper used in such a printer includes a full cutting in which the continuous paper is completely separated after printing, and a partial cutting in which the continuous paper is not completely cut and a part of the paper such as a center or an edge (side edge) of the paper is kept uncut. In a case in which a plurality of receipts or coupons is issued to be handed over in a lump to a customer, a mixed cutting method is adopted. In the mixed cutting method, the partial cutting is performed between printed matters (receipts or coupons) on the continuous paper and the full cutting is performed on two positions of one set, i.e., a leading end and a trailing end of one set of printed matters.

Such cutting methods are selected according to a type of business of a retail store and an operation method of a checkout apparatus. For example, in a POS terminal that is operated by a cashier (store clerk) and mainly issues a single receipt, it is preferable to apply the full cutting through which a cutting end of the receipt is clear and the time taken for the store clerk to tear the continuous paper is not necessary. On the other hand, the self-service checkout apparatus or the checkout apparatus of the semi-self-service system is generally operated by a customer. Therefore, it is preferable to apply the partial cutting in which the receipt is maintained to be appeared at a receipt issuing port after issuance of the receipt. The receipt stands out to attract customer's attention to prevent the receipt from being left, and also prevent the receipt from falling to the outside.

For these reasons, in a host apparatus for the printer of the POS terminal or the like, the cutting method is preset according to an operation of the host apparatus, and a command for instructing the cutting method is output together with the printing data. The printer cuts the continuous paper according to the command received together with the printing data.

On the other hand, the printer does not receive printing data from the host apparatus in an automatic feed operation and an automatic cutting operation for aligning and cutting a leading end of the continuous paper at the time of closing a cover of the printer after replacing the paper or after resolving an error, and thus the printer does not also receive the command for instructing the cutting method. A conventional printer automatically cuts the continuous paper by applying a default value of the cutting method that is preset before shipment. Therefore, if the preset cutting method is a general method different from the cutting method instructed from the host apparatus, there is a problem in which the continuous paper is automatically cut by the cutting method, as described above, with which an operator is not generally familiar, resulting in lacking of convenience.

DETAILED DESCRIPTION

In accordance with an embodiment, a printer comprises a cutter; a non-volatile storage module; a command receiving module configured to receive a command for instructing a cutting method of a continuous paper from an information processing apparatus connected to the printer; a first cutting control module configured to control an operation of the cutter to cut the continuous paper in the cutting method instructed by the command; a recording module configured to record information indicating the cutting method in the storage module at the time of paper cutting based on the command; and a second cutting control module configured to cut the continuous paper by a cutting method indicated by the information stored in the storage module at the time of paper cutting without the command.

A printer according to the present embodiment is described in detail with reference to the accompanying drawings. In the following description, a present invention is applied to a receipt printer connected to a POS terminal used in a retail store is described; however, it is not limited thereto. The printer according to the present embodiment may be mounted or connected to a self-service checkout apparatus or a checkout apparatus of a semi-self-service checkout system. Alternatively, the printer according to the present embodiment may be a label printer connected to an information processing apparatus such as a PC (Personal Computer).

Figure 1:
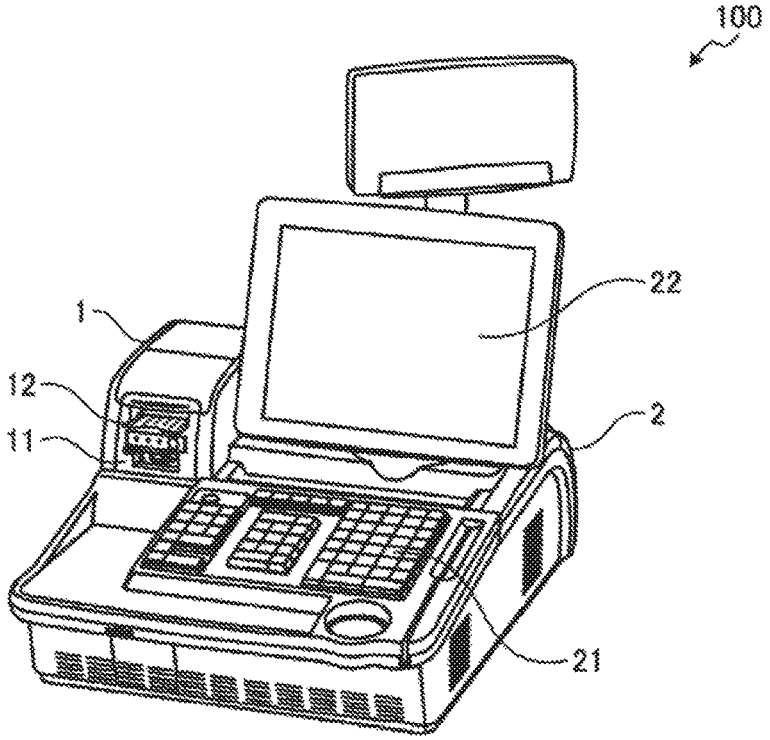
FIG. 1 is a diagram illustrating an external appearance of a POS system according to an embodiment.

FIG. 1 is a diagram illustrating an external appearance of a POS system according to the present embodiment. The POS system 100 includes a POS terminal 2 and a printer 1 connected to the POS terminal 2. The POS terminal 2 includes a keyboard 21. The POS terminal 2 receives an instruction for closing settlement of one transaction and issuing a receipt via the keyboard 21. The POS terminal 2 receives various operations via the keyboard 21 and also receives setting of a cutting method of the receipt by the printer 1.

As the cutting method of the receipt, for example, a full cutting for completely separating a continuous paper after printing, or a partial cutting for keeping a part of the continuous paper such as a center or an edge of the paper in the width direction uncut can be preset. A CPU (Central Processing Unit) of the POS terminal 2 stores the cutting method selected by a user in a non-volatile memory, and outputs a command for instructing the cutting method set in the memory to the printer 1 together with receipt data, i.e., printing data, at the time of issuing the receipt. In a case in which a display device 22 of the POS terminal 2 includes a touch panel, a setting of the cutting method or other instructions may be received through an operation on the touch panel.

The printer 1 prints the printing data received from the POS terminal 2 serving as a host device on a receipt paper accommodated in a housing 11, to issue the printed receipt paper from a receipt issuing port 12. The printer 1 switches the cutting method between the full cutting and the partial cutting according to the cutting method instructed by the command received from the POS terminal 2 to cut the receipt paper according to the switched cutting method.

Figure 2:
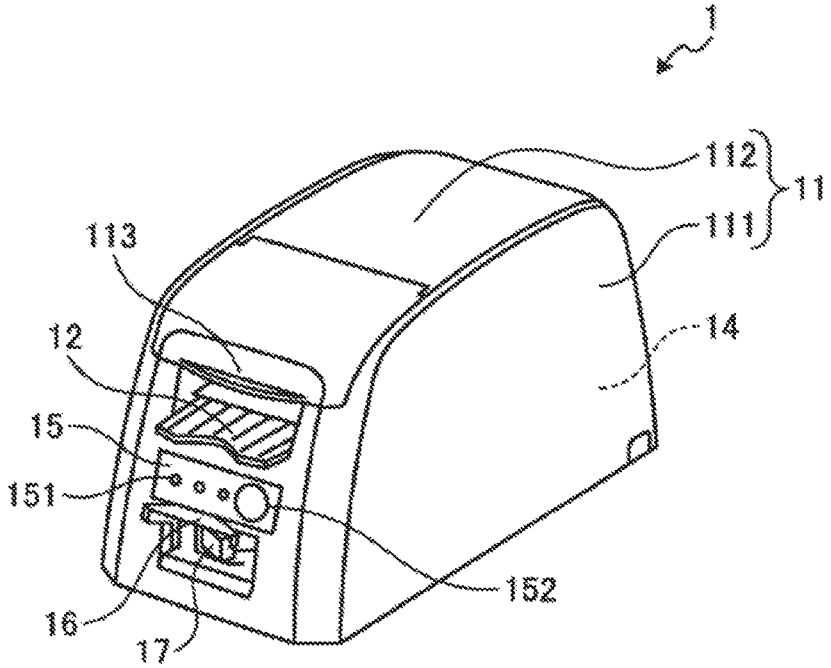
FIG. 2 is a perspective view illustrating an external appearance of a printer.

FIG. 2 is a perspective view illustrating an external appearance of the printer 1. At the inside of the housing 11 of the printer 1, a storing section 14 for storing a continuous paper, e.g., a rolled paper, is provided. The continuous paper is, for example, a heat sensitive paper and is printed to be issued, for example, as a receipt or a coupon. As shown in FIG. 2, the housing 11 has a lower housing 111 and a cover 112 serving as a lid of the lower housing 111. The storing section 14 is arranged in the lower housing 111. The cover 112 is provided with an opening/closing lever 113, and the cover 112 can be opened by lifting the opening/closing lever 113 upwards. The continuous paper serving as a receipt paper stored in the storing section of the lower housing 111 can be replaced when the cover 112 is opened. On a front surface of the lower housing 111 below the opening/closing lever 113, the receipt issuing port 12 described above is provided. The receipt paper to which a printing processing is performed by a thermal head 33 (refer to FIG. 3) is discharged from the receipt issuing port 12 and then fully cut or partially cut by a cutter 360 (refer to FIG. 3) provided on the rear side of the receipt issuing port 12 to be issued as a receipt.

An operation-display section 15 is provided below the receipt issuing port 12 on the front surface of the lower housing 111. The operation-display section 15 has a plurality of LEDs 151 for informing operation states such as a paper shortage and a paper jam in the printer 1. The operation-display section 15 has an automatic cutting button 152 for instructing an automatic feeding and an automatic cutting thereon. After replacing the receipt paper (continuous paper), or after an error such as the paper jam occurs, it is preferable to cut a leading end of the continuous paper to align the end thereof tidily, and a distance from the end of the continuous paper to a printing position is uniformly arranged. The automatic cutting button 152 is operated to instruct an operation of automatically feeding and cutting the continuous paper at such timing.

A switch cover 16 capable of being opened and closed against the lower housing 111 is provided below the operation-display section 15 on the front surface of the lower housing 111. When the switch cover 16 is opened, a power switch 17 for performing on or off of a power supply to the printer 1 is arranged in the lower housing 111. When the power switch 17 is operated, the printer 1 firstly performs the automatic feeding and then the automatic cutting to align the leading end of the continuous paper.

Figure 3:
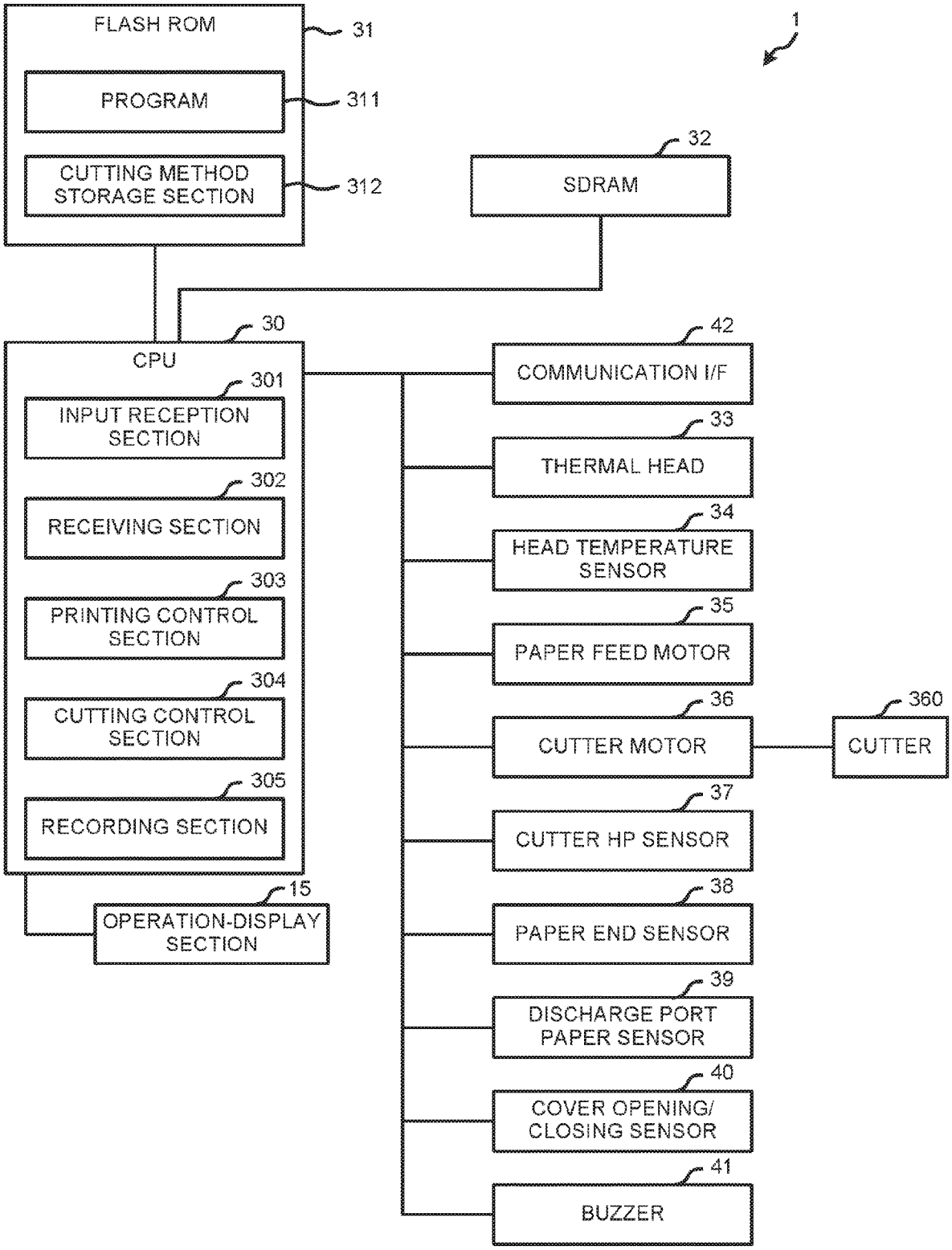
FIG. 3 is a block diagram illustrating functional components of the printer.

FIG. 3 is a block diagram illustrating functional components of the printer 1. As shown in FIG. 3, the printer 1 includes a CPU 30 that executes various calculations to control each section. A flash ROM (Flash Read Only Memory) 31, i.e., a non-volatile memory, and an SDRAM (Synchronous Dynamic Random Access Memory) 32, i.e., a volatile memory, are connected to the CPU 30 via a bus line. Except for the flash ROM, other types of non-volatile memories may be used.

The flash ROM 31 stores a program 311, and a cutting method storage section 312 is arranged therein. The cutting method storage section 312 functions as a storage module for storing information indicating a cutting method when the continuous paper is cut. The cutting method storage section 312 may store a command for instructing a cutting method received from the POS terminal 2 or information indicating a method for cutting the trailing end when cutting the continuous paper according to the command as the information indicating the cutting method.

The program 311 has a module configuration including an input reception section 301, a receiving section 302, a printing control section 303, a cutting control section 304 and a recording section 305. The CPU 30 reads out the program 311 from the flash ROM 31 onto a main storage device, and copies or decompresses the program. In this way, the input reception section 301, the receiving section 302, the printing control section 303, the cutting control section 304 and the recording section 305 are generated on the main storage device.

As shown in FIG. 3, a communication I/F (Interface) 42, the thermal head 33, a head temperature sensor 34, a paper feed motor 35, a cutter motor 36, a cutter HP (Home Position) sensor 37, a paper end sensor 38, a discharge port paper sensor 39, a cover opening/closing sensor 40, and a buzzer 41 are connected to the CPU 30 via the bus line.

The communication I/F 42 is a USB (Universal Serial Bus), and the CPU 30 is connected to a CPU of the POS terminal 2 via the communication I/F 42. The thermal head 33 includes a plurality of heat generation elements arranged in line, and thermally transfers the printing data received from the POS terminal 2 onto a heat sensitive paper. The head temperature sensor 34 measures a temperature of the thermal head 33 composed of a plurality of heat generation elements. The CPU 30 controls an energization level to the thermal head 33 so that the temperature of the heat generation elements is maintained at an appropriate temperature.

The paper feed motor 35 functions as a power source for rotating a holding shaft for holding a core of the rolled paper to feed the continuous paper to the printing position where the thermal head 33 and the platen roller face each other. The cutter motor 36 controls the operation of the cutter 360 provided in the vicinity of the receipt issuing port 12 to fully or partially cut the continuous paper. The cutter HP sensor 37 detects that the cutter 360 returns to a home position. After cutting the continuous paper, the CPU 30 drives the cutter motor 36 to move the cutter 360 towards the home position based on the detection result from the cutter HP sensor 37 until the cutter 360 returns to the home position.

The paper end sensor 38 is an optical sensor provided in the vicinity of the receipt issuing port 12 at the inside of the housing 11, to detect the end of the continuous paper. When the paper end sensor 38 detects the end of the continuous paper, the CPU 30 turns on the LED 151 of the operation-display section 15 to notify a user that the continuous paper runs out. The discharge port paper sensor 39 is an optical sensor to detect that the continuous paper (printed paper) is discharged to the receipt issuing port 12.

The cover opening/closing sensor 40 is provided at the inside of the housing 11 to detect an open state or a closed state of the cover 112 against the printer 1. A configuration of the cover opening/closing sensor 40 is not particularly limited, but, for example, a mechanical switch may be applied as the cover opening/closing sensor 40. In this case, the switch is pressed to be turned on when the cover 112 is in the closed state against the lower housing 111, and in this way, it is possible to detect that the cover 112 is closed against the lower housing 111. The buzzer 41 outputs a buzzer sound to notify the user of the occurrence of an error.

Next, the functional configuration of the program 311 is described.

The input reception section 301 receives an operation input of the automatic cutting button 152 (refer to FIG. 2) on the operation-display section 15. The input reception section 301 receives input of detection signals from various sensors.

For example, the input reception section 301 receives a cover opening signal indicating that the cover 112 is open against the lower housing 111 from the cover opening/closing sensor 40. The input reception section 301 receives a cover closing signal indicating that the cover 112 is closed against the lower housing 111 of the printer 1 from the cover opening/closing sensor 40. The cover opening/closing sensor 40 may detect one of the open state and the closed state and output a signal indicating the corresponding state.

Thus, the cover opening/closing sensor 40 and the input reception section 301 function as a detection module for detecting that the cover 112 of the storing section 14 is closed.

The receiving section 302 (command receiving module) receives a command indicating the cutting method of the continuous paper together with the printing data from the POS terminal 2 via the communication I/F 42. Specifically, the receiving section 302 receives one of the full cutting command, the partial cutting command and a mixed cutting command together with the printing data from the POS terminal 2.

The full cutting command instructs to cut the continuous paper in the manner of the full cutting for completely separating the continuous paper in a width direction thereof. The partial cutting command instructs to cut the continuous paper in the manner of the partial cutting for keeping a part of the continuous paper in the width direction uncut. The mixed cutting command instructs to cut the continuous paper in the manner of both the full cutting and the partial cutting in a case in which printing is continuously or repeatedly performed on the continuous paper. In the present embodiment, a plurality of printed mattes such as receipts or coupons is formed on the continuous paper to be issued as a set. The plurality of printed matters repeatedly printed on the continuous paper (hereinafter referred to simply as printed papers) becomes a plurality of receipts or a plurality of coupons after cutting.

The mixed cutting command may simply instruct to perform the mixed cutting. Specifically, for example, in the mixed cutting, there is a case in which a combination of the full cutting and the partial cutting is uniformly fixedly applied in such a manner that the leading end of the initial printed paper (a receipt or a coupon) and the trailing end of the last printed paper are fully cut, and the leading end and trailing end of the printed paper in the middle are partially cut. In such an application, the mixed cutting command may simply instruct to perform the mixed cutting.

Alternatively, in the mixed cutting command, the full cutting and the partial cutting may be instructed for each printed paper (a receipt or a coupon). In this case, the POS terminal 2 may select one of different cutting methods according to the printing data.

When the receiving section 302 receives the printing data, the printing control section 303 drives the paper feed motor 35 to feed the continuous paper towards the printing position of the thermal head 33. The printing control section 303 outputs the printing data received by the receiving section 302 to the thermal head 33 and the thermal head 33 thermally transfers the printing data onto the continuous paper to control the printing operation.

The cutting control section 304 (first cutting control module) controls the operation of the cutter 360 to cut the continuous paper in the cutting method instructed in the command received from the POS terminal 2. The cutting control section 304 (second cutting control module) cuts the continuous paper in the cutting method stored in the cutting method storage section 312 at the time of the paper cutting without the command from the POS terminal 2.

There are the following cases as so-called automatic cutting in which the paper is cut regardless of the command from the POS terminal 2.

(1) A processing in which automatically feeding and automatically cutting of the continuous paper are performed to align the position of the leading end of the continuous paper at the predetermined position and then completely cut of the end is performed after the cover 112 is closed at the time of replacing the paper.

(2) A processing in which automatically feeding and automatically cutting of the continuous paper are performed to align the position of the leading end of the continuous paper at a predetermined position and then completely cut of the end is performed when the automatic cutting button 152 is operated.

(3) A processing in which automatically feeding and automatically cutting of the continuous paper are performed to align the position of the leading end of the continuous paper at the predetermined position and completely cut of the end is performed after the power supply is turned on. The processing of item (3) may be enabled or disabled by setting or switching according to a request from the user.

For the case of item (1), when the input reception section 301 receives a cover closing signal from the cover opening/closing sensor 40 and detects that the cover 112 of the storing section 14 is closed, the cutting control section 304 starts the operation of automatically feeding the continuous paper and automatically cutting the leading end of the continuous paper.

For the case of item (2), when the input reception section 301 receives the operation on the automatic cutting button 152, the cutting control section 304 starts the operation of automatically feeding the continuous paper and automatically cutting the leading end of the continuous paper.

For the case of item (3), after the power supply of the printer 1 is turned on, the cutting control section 304 starts the operation of automatically feeding the continuous paper and automatically cutting the leading end of the continuous paper.

The operation of automatically feeding the continuous paper and automatically cutting the end (leading end) of the continuous paper performed by the cutting control section 304 may be, for example, the following operation. The cutting control section 304 drives the paper feed motor 35 to feed the printed paper to the receipt issuing port 12 (refer to FIG. 2) until the discharge port paper sensor 39 detects the end (leading end) of the printed paper. When the discharge port paper sensor 39 detects the leading end of the printed paper, the cutting control section 304 determines the cutting method used at last at the time of the previous cutting based on the information stored in the cutting method storage section 312, and drives the cutter motor 36 to cut the continuous paper with the cutter 360 according to the determined cutting method. After cutting the continuous paper, the cutting control section 304 drives the cutter motor 36 until the cutter HP sensor 37 detects the cutter 360 returned to the home position.

The timing at which adjustment of the position of the continuous paper based on the position detection by the discharge port paper sensor 39 is performed is not particularly limited, and the adjustment may be performed before the automatic cutting as described above, or may be further performed after the automatic cutting.

In the above description, the automatic feed operation is performed in addition to the automatic cutting as a set so that the end of the paper is positioned at a predetermined position before the automatic cutting of the paper is performed. However, the automatic feeding is not necessarily performed as a set of the automatic cutting. For example, an operation button for instructing only the automatic cutting may be provided. In this case, the user operates the operation button after manually pulling out the paper and the printer 1 performs the automatic cutting only. Then, at the time the printer 1 issues an instruction to cut the paper regardless of the command from the POS terminal 2 as described above, the cutting control section 304 may cut the paper in the cutting method stored in the cutting method storage section 312.

The recording section 305 (recording module) records information indicating the cutting method in the cutting method storage section 312 when the paper is cut according to the command from the POS terminal 2. The recording section 305 may record a command for instructing the cutting method received from the POS terminal 2 in the cutting method storage section 312 as the information indicating the cutting method. Alternatively, the recording section 305 may record information indicating the cutting method for the last trailing end of the printed papers in the cutting method storage section 312 when the paper is cut according to the command received from the POS terminal 2 as information indicating the cutting method.

As the cutting method for the last trailing end of the printed papers, information indicating the full cutting is recorded at the time of receiving the full cutting command, and information indicating the partial cutting is recorded at the time of receiving the partial cutting command. Then, at the time of receiving the mixed cutting command, information indicating the cutting method of the trailing end of the printed paper (receipt or coupon) issued at the last is recorded. As described above, if the combination of cutting methods at the time of the mixed cutting is fixed uniformly in operation, the cutting method for the last trailing end is fixed uniformly. As described above, when the leading end of the initial printed paper (receipt or coupon) and the trailing end of the last printed paper are fully cut, and the partial cutting is fixed as the cutting method of the printed paper or papers in the middle, the last trailing end of the printed papers is fully cut without exception. Therefore, if it is known beforehand that the last trailing end is fully cut without exception, the recording section 305 may simply record the information indicating the mixed cutting or information indicating that the last trailing end is fully cut in the cutting method storage section 312.

On the other hand, if the full cutting or the partial cutting is designated for each printed paper in the mixed cutting command as described above, even if the information simply indicating the mixed cutting command is stored in the cutting method storage section 312, the cutting method for the last trailing end is not determined uniquely. Therefore, based on the received mixed cutting command, the recording section 305 determines whether the cutting method of the trailing end of the printed paper issued at the last is the full cutting or the partial cutting. The recording section 305 records the cutting method of the last trailing end of the printed paper in one set in the cutting method storage section 312 based on the determination result.

Next, procedures of each processing performed by the printer 1 are described.

Figure 4:
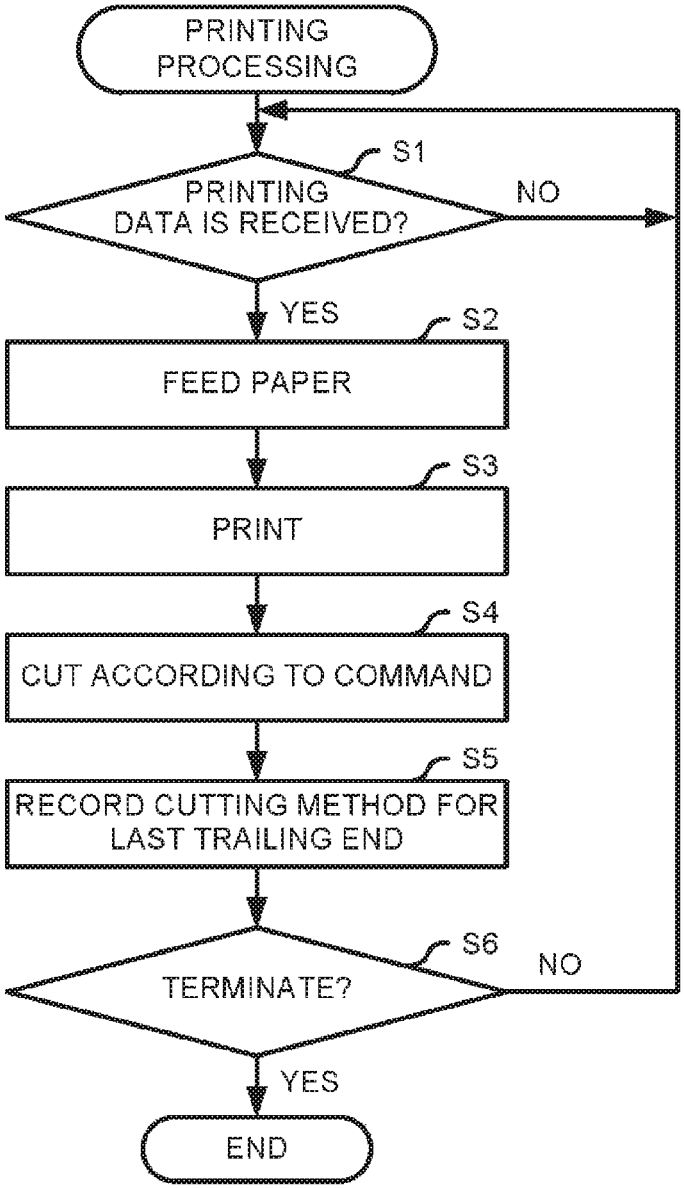
FIG. 4 is a flowchart depicting procedures of a printing processing performed by the printer.

FIG. 4 is a flowchart depicting procedures of the printing processing performed by the printer 1. The receiving section 302 determines whether or not the printing data and the command indicating the cutting method of the printed paper are received from the POS terminal 2 via the communication I/F 42 (Act S1). If No is taken in Act S1, the receiving section 302 stands by until the printing data and the command are received (Act S1). If the printing data and the command are received (Yes in Act S1), the printing control section 303 drives the paper feed motor 35 to feed the continuous paper towards the printing position of the thermal head 33 (Act S2). The printing control section 303 controls the printing operation by thermally transferring the printing data onto the continuous paper through the thermal head 33 (Act S3).

If the printing operation is completed, the cutting control section 304 drives the cutter motor 36 to cut the paper (printed paper) in the cutting method indicated by the command received in Act S1 (Act S4). The recording section 305 records the cutting method of the trailing end of the last printed paper in Act S4 in the cutting method storage section 312 (Act S5). Next, it is determined whether the receiving section 302 receives a command to terminate the printing processing from the POS terminal 2 (Act S6). If No is taken in Act S6, the CPU 30 returns to the processing in Act S2 and the receiving section 302 stands by until the next printing data is received. If Yes is taken in Act S6, the CPU 30 terminates the printing processing.

Next, procedures of the automatic feed and automatic cutting processing performed by the printer 1 are described. The processing is executed in such a manner that it can be interrupted against the printing processing shown in FIG. 4.

Figure 5:
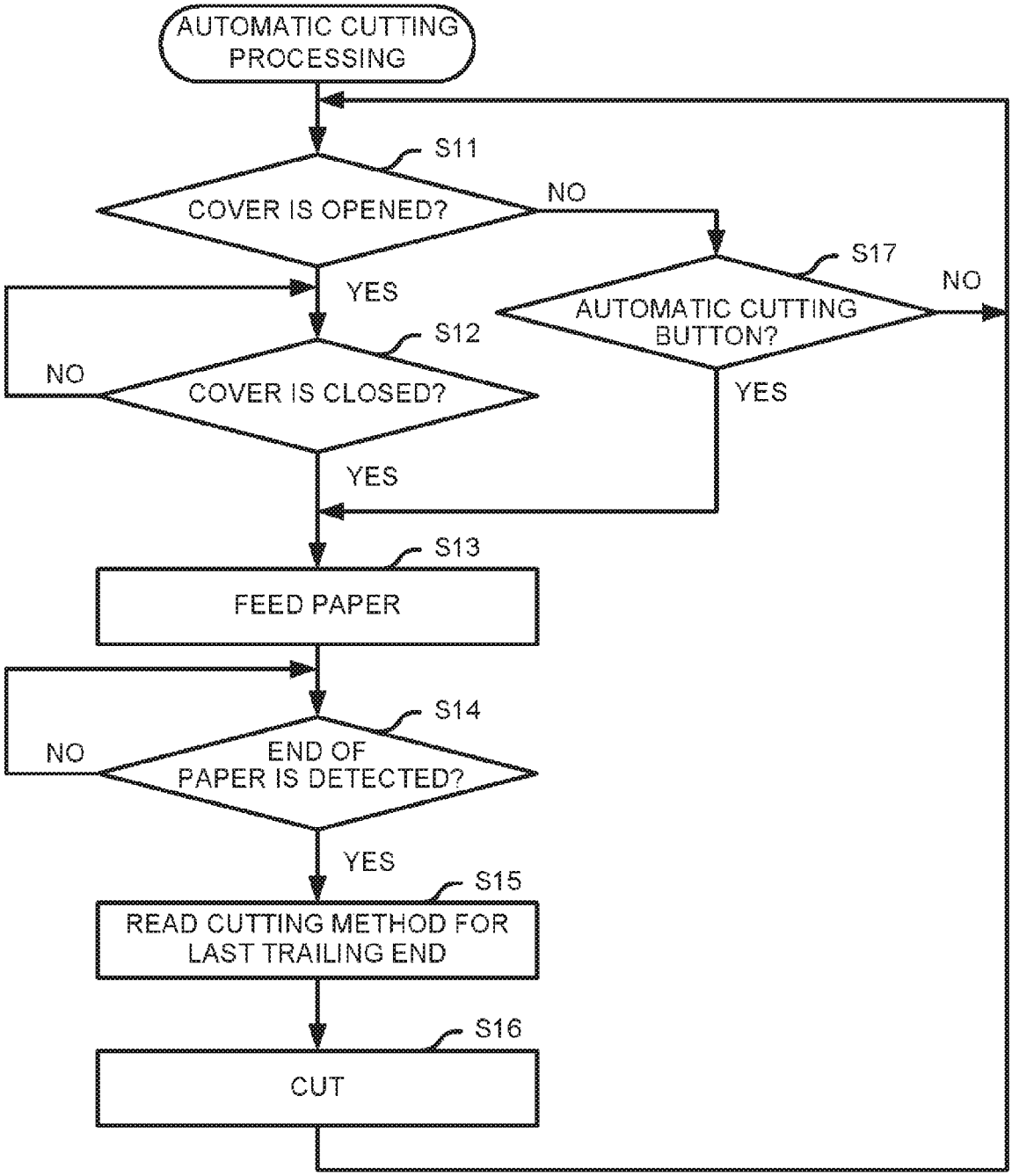
FIG. 5 is a flowchart depicting procedures of an automatic feed and automatic cutting processing performed by the printer.

FIG. 5 is a flowchart depicting procedures of the automatic feeding and automatic cutting processing performed by the printer 1. FIG. 5 illustrates a paper saving manner in which, for example, the automatic cutting is performed at the timing of items (1) and (2) described above, and the automatic cutting at the time the power supply is turned on in item (3) described above is not performed.

The input reception section 301 determines whether or not the cover opening/closing sensor 40 detects that the cover 112 is opened (Act S11). If Yes is taken in Act S11, the input reception section 301 determines whether or not the cover opening/closing sensor 40 detects that the cover 112 is closed (Act S12). If No is taken in Act S12, the input reception section 301 stands by until it is detected that the cover 112 is closed (Act S12). If Yes is taken in Act S12, the CPU 30 proceeds to the processing in Act S13. On the other hand, If No is taken in Act S11, the input reception section 301 determines whether or not the automatic cutting button 152 is operated (Act S17). If Yes is taken in Act S17, the CPU 30 proceeds to the processing in Act S13. If No is taken in Act S17, the CPU 30 returns to the processing in Act S11.

In Act S13, the cutting control section 304 drives the paper feed motor 35 to feed the continuous paper towards the receipt issuing port 12 (refer to FIG. 2) (Act S13). The input reception section 301 determines whether or not the discharge port paper sensor 39 detects the leading end of the continuous paper (Act S14). If No is taken in Act S14, the paper feed is continued, but if Yes is taken in Act S14, the CPU 30 proceeds to the processing in Act S15. The cutting control section 304 reads the information indicating the cutting method of the last trailing end of a previous printed paper, e.g., receipt or coupon, stored in the cutting method storage section 312 (Act S15). Then, the cutting control section 304 drives the cutter motor 36 according to the cutting method indicated by the information read from the cutting method storage section 312 in Act S15 to cut the continuous paper in the manner of full cutting or partial cutting (Act S16). Thereafter, the CPU 30 returns to the processing in Act S11 to standby until the input of the operation serving as a trigger for the automatic feeding and automatic cutting is received.

As described above, according to the above embodiment, the information indicating the cutting method performed at the time of cutting the continuous paper is recorded, and the paper is cut according to the recorded cutting method at the time of automatically cutting the end of the paper. As a result, according to the present embodiment, a printer capable of cutting the paper in the cutting method according to a state of use of the host device at the time of cutting the paper can be provided regardless of the command from the host device.

The program 311 executed by the printer 1 of the present embodiment may be incorporated into the flash ROM 31 to be provided. The program 311 executed by the printer 1 of the present embodiment may be recorded in a computer-readable recording medium such as a CD-ROM (Compact Disc Read-Only Memory), an FD (Flexible Disk), a CD-R (Compact Disk Recordable), a DVD (Digital Versatile Disk) and the like in the form of installable or executable file to be provided.

Further, the program 311 executed by the printer 1 of the present embodiment may be provided by being stored in a computer connected with a network such as the Internet and downloaded via the network. The program 311 executed by the printer 1 of the present embodiment may be provided or distributed via the network such as the Internet.

In the present embodiment, for example, a stub cutting in which the paper is cut in a perforated manner may be used instead of the partially cutting and the stub cutting and the above-described full cutting are switched. Then, one of the full cutting and the stub cutting performed at the time of cutting the trailing end of the printed paper at the last time is recorded in the storage module, and the full cutting and the stub cutting are switched according to the recorded contents to perform the automatic cutting.

Although the example in which the POS terminal 2 is applied as an information processing apparatus connected to the printer 1 is described above, the application of the information processing apparatus (host device) is not limited to the POS terminal 2. As another example, in a case in which a registration apparatus and a checkout apparatus are used in the semi-self-service type checkout system, the registration apparatus may be applied as the information processing device, and the registration apparatus transmits the printing data and the command to the printer of the checkout apparatus as an application of the above embodiment. In a self-service checkout system, a control section of the self-service checkout apparatus may be applied as the information processing apparatus, and the control section transmits the printing data and the command to the printer of the self-service checkout apparatus as an application of the above embodiment.

In a label printer connected to the PC (host device), a control section of the PC transmits the printing data and the command to the label printer as an application of the above embodiment.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a cutter;

a storage module;

a command receiving module configured to receive, from an information processing apparatus connected to the printer, a command that defines a cutting method selected from a full cut cutting method, a partial cut cutting method, or a mixed cutting method;

a first cutting control module configured to control a first operation of the cutter to cut a continuous paper via the cutting method defined by the command;

a recording module configured to record information to the storage module, the information indicating the cutting method at the time of the first operation; and a second cutting control module configured to control a second operation of the cutter to cut the continuous paper based on the information recorded to the storage module.

2. The printer according to claim 1, wherein the full cut cutting method consists of a full cut operation that completely cuts the continuous paper in a width direction thereof to be separated in the manner of full cutting, the partial cut cutting method consists of a partial cut operation that partially cuts the continuous paper in the width direction and a part of the continuous paper is kept uncut in the manner of partial cutting, and the mixed cutting method comprises at least one full cut operation and at least one partial cut operation.

3. The printer according to claim 2, wherein the command defines the cutting method as the mixed cutting method, the second operation defines a set of printed papers from the continuous paper, and the information delineates the mixed cutting method and whether a trailing end of a last printed paper of the set is defined by one of: the at least one full cut operation, or the at least one partial cut operation.

4. The printer according to claim 1, further comprising:

a storing section configured to store the continuous paper; and a detection module configured to detect that a cover of the storing section is closed, wherein the second cutting control module cuts the continuous paper via the cutting method indicated by the information stored in the storage module after automatically feeding the continuous paper based on a detection by the detection module that the cover is closed.

5. The printer according to claim 1, further comprising:

a reception module configured to receive an operation instruction to automatically cut the continuous paper, wherein the second cutting control module automatically cuts the continuous paper via the second operation based on the reception module receiving the operation instruction.

6. The printer according to claim 1, further comprising:
a discharge port paper sensor that detects a leading end of printed paper.

7. The printer according to claim 1, wherein
the storage module is a non-volatile storage module.

8. A method for cutting a continuous paper by a printer comprising a cutter and a storage module, comprising:
receiving, from an information processing apparatus connected to the printer, a command that defines a cutting method selected from a full cut cutting method, a partial cut cutting method, or a mixed cutting method;
controlling first operation of the cutter to cut a continuous paper via the cutting method defined by the command;
recording information to the storage module, the information indicating the cutting method at the time of the first operation; and
controlling a second operation of the cutter to cut the continuous paper based on the information recorded to the storage module.

9. The method according to claim 8, wherein
the full cut cutting method consists of a full cut operation that completely cuts the continuous paper in a width direction thereof to be separated in the manner of full cutting,
the partial cut cutting method consists of a partial cut operation that partially cuts the continuous paper in the width direction and a part of the continuous paper is kept uncut in the manner of partial cutting, and
the mixed cutting method comprises at least one full cut operation and at least one partial cut operation.

10. The method according to claim 9, wherein
the command defines the cutting method as the mixed cutting method,
the second operation defines a set of printed papers from the continuous paper, and
the information delineates the mixed cutting method and whether a trailing end of a last printed paper of the set is defined by one of: the at least one full cut operation, or the at least one partial cut operation.

11. The method according to claim 8, further comprising:
storing the continuous paper;
detecting that a cover of a storing section is closed; and
cutting the continuous paper via the cutting method indicated by the information stored in the storage module after automatically feeding the continuous paper based on the detecting that the cover is closed.

12. The method according to claim 8, further comprising:
receiving an operation instruction to automatically cut the continuous paper; and
cutting the continuous paper via the second operation based on the receiving the operation instruction.

13. The method according to claim 8, further comprising:
detecting a leading end of printed paper.

14. A point of sales (POS) terminal, comprising:
a printer;
a cutter;
a storage module;
a command receiving module configured to receive, from an information processing apparatus connected to the POS terminal, a command that defines a cutting method selected from a full cut cutting method, a partial cut cutting method, or a mixed cutting method;
a first cutting control module configured to control a first operation of the cutter to cut a continuous paper via the cutting method defined by the command;
a recording module configured to record information to the storage module, the information indicating the cutting method at the time of the first operation; and
a second cutting control module configured to control a second operation of the cutter to cut the continuous paper based on the information recorded to the storage module.

15. The POS terminal according to claim 14, wherein
the full cut cutting method consists of a full cut operation that completely cuts the continuous paper in a width direction thereof to be separated in the manner of full cutting,
the partial cut cutting method consists of a partial cut operation that partially cuts the continuous paper in the width direction and a part of the continuous paper is kept uncut in the manner of partial cutting, and
the mixed cutting method comprises at least one full cut operation and at least one partial cut operation.

16. The POS terminal according to claim 15, wherein
the command defines the cutting method as the mixed cutting method,
the second operation defines a set of printed papers from the continuous paper, and
the information delineates the mixed cutting method and whether a trailing end of a last printed paper of the set is defined by one of: the at least one full cut operation, or the at least one partial cut operation.

17. The POS terminal according to claim 14, further comprising:
a storing section configured to store the continuous paper; and
a detection module configured to detect that a cover of the storing section is closed, wherein
the second cutting control module cuts the continuous paper in the cutting method indicated by the information stored in the storage module after automatically feeding the continuous paper a detection by the detection module that the cover is closed.

18. The POS terminal according to claim 14, further comprising:
a reception module configured to receive an operation instruction to automatically cut the continuous paper, wherein
the second cutting control module automatically cuts the continuous paper via the second operation based on the reception module receiving the operation instruction.

19. The POS terminal according to claim 14, further comprising:
a discharge port paper sensor that detects a leading end of printed paper.

20. The POS terminal according to claim 14, wherein
the storage module is a non-volatile storage module and the printer is a thermal printer.

* * * * *